United States Patent [19]

Fukuzawa et al.

[11] Patent Number: 4,914,449

[45] Date of Patent: Apr. 3, 1990

[54] MICROWAVE ANTENNA STRUCTURE WITH INTERGRAL RADOME AND REAR COVER

[75] Inventors: Keiji Fukuzawa, Chiba; Takashi Otsuka, Kanagawa; Shinobu Tsurumaru, Kanagawa; Junichi Kajikuri, Kanagawa; Fumihiro Ito, Tokyo, all of Japan

[73] Assignee: Sony Corporation, Tokyo, Japan

[21] Appl. No.: 277,313

[22] Filed: Nov. 29, 1988

[30] Foreign Application Priority Data

Nov. 30, 1987 [JP] Japan ..... 62-301916

[51] Int. Cl.[4] ..... H01Q 1/42; H01Q 1/38

[52] U.S. Cl. ..... 343/872; 343/700 MS

[58] Field of Search ..... 343/700 MS, 778, 872

[56] References Cited

U.S. PATENT DOCUMENTS 4,614,947 9/1986 Rammos ..... 343/778
4,766,444 8/1988 Conroy et al. ..... 343/700 MS
4,772,890 9/1988 Bowen et al. ..... 343/700 MS
4,829,309 5/1989 Tsukamoto et al. ..... 343/700 MS
4,829,314 5/1989 Barbier et al. ..... 343/778

*Primary Examiner*—Rolf Hille
*Assistant Examiner*—Doris J. Johnson
*Attorney, Agent, or Firm*—Hill, Van Santen, Steadman & Simpson

[57] ABSTRACT

A suspended line feed type planar antenna is arranged with a number of antenna elements formed on a film-shaped substrate, and the film-shaped substrate is sandwiched between a plastic radome and a plastic rear cover, a conductive surface is plated on the rear surface of the plastic radome at its portion except the portions opposing the antenna elements and/or a conductive surface is plated on the whole front surface of the rear cover. The conductive surfaces and the antenna elements constitute resonance type printed path radiators, whereby the planar antenna of the invention can be simplified in construction and reduced in cost, thickness and weight, and the planar antenna of the invention can be increased in productivity and reliability.

10 Claims, 2 Drawing Sheets

MICROWAVE ANTENNA STRUCTURE WITH INTERGRAL RADOME AND REAR COVER

BACKGROUND OF THE INVENTION

The present invention relates generally to a planar array type microwave antenna for use in receiving, for example, a satellite broadcast and more particularly, to a suspended line feed type planar antenna.

In the past, a suspended line feed type planar array antenna has been proposed in which a substrate is sandwiched between metal or metallized plastic plates having a number of spaced openings forming a part of radiation elements, constituting a circular polarized wave planar array antenna, in which a pair of excitation probes, which are perpendicular to each other, with a number of pairs which corresponds to the number of spaced openings, are formed on a common plane and the signals fed to the pair of excitation probes are mixed in phase within the suspended line (in our co-pending U.S. patent applications Ser. No. 888,117 filed on July 22, 1986 and Ser. No. 058,286 filed on June 4, 1987).

Thus, the above-mentioned planar antenna can be reduced in thickness and its mechanical configuration can be simplified. Further, though on inexpensive substrate available on t he market is employed for a high frequency use, an antenna gain equal to or larger than that of the planar antenna using an expensive microstrip line can be achieved.

The suspended line can achieve the advantages that it forms a low loss line for feeding the planar antenna, and also that it can be formed on an inexpensive film-shaped substrate, and so on. Further, since this conventional planar antenna utilizes a circular or rectangular waveguide opening element as a radiation element, it is possible to construct an array antenna which has small gain deviation over a relatively wide frequency range.

Meanwhile, a so-called patch type microstrip line antenna has been proposed in order to reduce the thickness of the planar array antenna. Also, this patch type microstrip line antenna can be made high in efficiency and wide in band range by effective use of the advantages of the suspended line and the use of a thin radiation element, and it can be reduced in thickness and in weight at the same time, as is disclosed in our co-pending U.S. patent application Ser. No. 223,781 filed on July 25, 1988 and Ser. No. 258,728 filed on Oct. 7, 1988.

In a suspended line feed type planar array antenna in which a substrate is sandwiched between a pair of metal or metallized plastic plates, the resonance type printed patch radiators are formed on the substrate at positions corresponding to slots formed through one of the metal or metallized plastic plates thereby to form the planar antenna.

The thus formed antenna body is enclosed by a rear cover and a radome as shown in perspective view forming FIG. 1. Referring to FIG. 1, a bottom plate 2 made of metal or metallized plastic is located on a rear cover 1, and on the bottom plate 2, there is provided a film-shaped substrate 3 on which a number of resonance type printed patch radiators (antenna elements) are arranged. This film-shaped substrate 3 is sandwiched between the bottom plate 2 and a top plate 5 made of metal or metallized plastic having a number of spaced openings 4 corresponding to the respective antenna elements. The top plate 5, the film-shaped substrate S and the bottom plate 2 are fastened to the rear cover 1 by some suitable means such as screws or the like, though not shown. A support cushion 6 for supporting the radome 7 is provided on the top plate 5 which is then enclosed by the radome 7.

FIG. 2 is a fragmentary, cross-sectional view of the conventional planar antenna which is thus assembled to form a multi-layer structure.

In the above-mentioned conventional planar antenna, the rear cover 1 and the bottom plate 2 are formed independently, and also the radome 7 and the top plate 5 are formed independently so that the number of assembly parts is increased thereby, the structure thereof becomes complicated, the assembly-process thereof becomes sufficiently complicated as to degrade the productivity, the manufacturing cost is increased and the wight thereof is increased and so on.

Further, the top and bottom plates 2 and 5 and the substrate 3 must be secured to the rear cover 1 by using many screws, thus making the assembly-process cumbersome and degrading the productivity.

OBJECTS AND SUMMARY OF THE INVENTION

Accordingly, it is an object of the present invention to provide a planar array antenna which can decrease the number of assembly parts.

It is still another object of the present invention to provide a planar array antenna which can be simplified in construction.

It is a further object of the present invention to provide a planar array antenna which can be manufactured at low cost.

It is a yet further object of the present invention to provide a planar array antenna which can be reduced in thickness and in weight.

It is still a further object of the present invention to provide a planar array antenna which can be manufactured with increased productivity and reliability.

According to an aspect of the present invention, there is provided a suspended line feed type planar antenna comprising: a substrate sandwiched between top and bottom conductive surfaces; a plurality of radiators provided on said substrate; a radome positioned at the upper side of said top conductive surface; and a rear cover positioned at the lower side of said bottom conductive surface, characterized in that at least one of said top and bottom conductive surfaces is formed on one of the inner surfaces of said radome and said rear cover.

According to another aspect of the present invention, there is provided a suspended line feed type planar antenna comprising: a substrate sandwiched between top and bottom conductive surfaces; a plurality of radiators provided on said substrate; a plastic radome positioned at the upper side of said top conductive surface; and a plastic rear cover positioned at the lower side of said bottom conductive surface, characterized in that at least one of said top and bottom conductive surfaces is formed on one of the inner surfaces of said radome and said rear cover, as a metallized surface thereof.

According to a further aspect of the present invention, there is provided a suspended line type planar antenna comprising: a substrate sandwiched between top and bottom conductive surfaces, said top conductive surface having a plurality of spaced openings defining radiation elements; a corresponding plurality of radiators provided on said substrate in alignment with said plurality of openings, respectively; feeding means for co-phase feeding said radiators; a plastic radome positioned at the upper side of said top conductive surface; and a plastic rear cover positioned at the lower side of said bottom conductive surface, characterized in that at least one of said top and bottom conductive surfaces is formed on one of the inner surfaces of said radome and said rear cover, as a metallized surface thereof.

These, and other objects, features and advantages of the present invention will become apparent from the following detailed description of the preferred embodiment, to be taken in conjunction with the accompanying drawings, throughout which like reference numerals identify like elements and parts.

DETAILED DESCRIPTION OF THE PREFERRED EMBODIMENT

Figure 3:
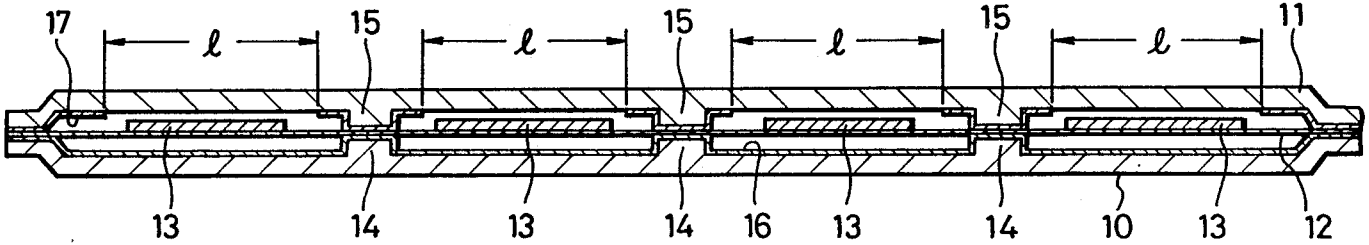
FIG. 3 is a cross-sectional view illustrating an embodiment of a planar array antenna structure according to the present invention.

Now, an embodiment of a planar array antenna structure according to the present invention will hereinafter be described in detail with reference to FIGS. 3 and 4. FIG. 3 illustrates an embodiment of the present invention.

As FIG. 3 shows, the planar array antenna of the invention comprises a plastic rear cover 10, a plastic radome 11 and a film-shaped substrate 12 sandwiched between the rear cover 10 and the radome 11. A number of resonance type printed patch radiators 13 are formed on the substrate 12 as printed elements (see U.S. patent application Ser. No. 223,781).

A plurality of protrusions 14 for supporting the substrate 12 are formed on the front surface (inner surface) of the rear cover 10 at positions which avoid the resonance type printed patch radiators 13 and the suspended line for connecting the printed patch radiators 13. Similarly, a plurality of protrusions 15 for supporting the substrate 12 are formed on the rear surface (inner surface) of the radome 11 in opposing relation to the protrusions 14 of the rear cover 10.

A metal plating layer or conductive surface 16 is formed on the entire front surface (inner surface) of the rear cover 10 so that the rear cover 10 acts as the bottom plate, i.e., substantially serves as the bottom plate. The conductive surface 16 and the printed patch radiators 13 constitute radiators. Further, a metal plating layer or conductive surface 17 is formed on the rear surface (inner surface) of the radome 11 except the portion (region shown by an arrow l in FIG. 3), substantially corresponding to the printed patch radiators 13. Thus, the radome 11 acts as the top plate and substantially serves as the top plate. The conductive surface 17 and the printed patch radiators 13 constitute radiators.

Figure 4:
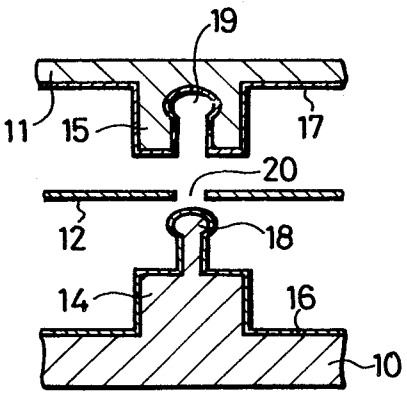
FIG. 4 is an enlarged, cross-sectional view illustrating a main portion of the planar array antenna according to the present invention.
Figure 2:
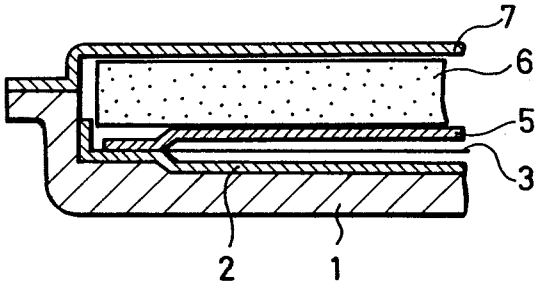
FIG. 2 (PRIOR ART)
FIG. 2 is a fragmentary, cross-sectional view of the conventional planar array antenna.

FIG. 4 illustrates a part of the protrusions 14 and 15 in an enlarged-scale. Referring to FIG. 4, a convex portion 18 is formed on the top of each of the protrusions 14, and a concave portion 19 is formed from the protruded portion of each of the protrusions 15 in response to the convex portion 18. The substrate 12 has a through-hole 20 through which the convex portion 18 passes. When upon assembly the convex portion 18 is engaged into the concave portion 19 by pushing the rear cover 10, the substrate 12 and the radome 11 can be secured to the rear cover 10 in a one-touch way, thus supporting the film-shaped substrate 12 between the protrusions 14 and 15.

In the above-mentioned embodiment of the invention, the metal plating layer is formed on the inner surface of the rear cover 10, and the inner surface of the rear cover 10 is made as the conductive layer. Also, the metal plating layer is formed on the inner surface of the radome 11 and the inner surface of the radome 11 is made as the conductive layer. Accordingly, the separate bottom and top plates which are both used for form the radiators in the past can be removed, and the support cushion which supports the radome 11 can be also removed. Thus, the number of assembly parts can be reduced, the structure of the antenna can be simplified and the antenna can be assembled with ease. Further, the costs of the whole assembly parts can be decreased and the antenna can be reduced in thickness and in weight. In addition, the antenna of the invention becomes more attractive from a product standpoint and the number of assembly parts thereof is few, thus increasing the reliability.

While in the prior art the plates or the like are secured to the rear cover by using a number of screws, in this embodiment, the rear cover and the radome can be secured in a one-touch or snap-in way by engaging the convex and concave portions. Thus, the assembly-process can be reduced and the productivity of the antenna of the invention can be increased. Further, the engagement between the convex and the concave portions can be served to position the substrate.

Figure 1:
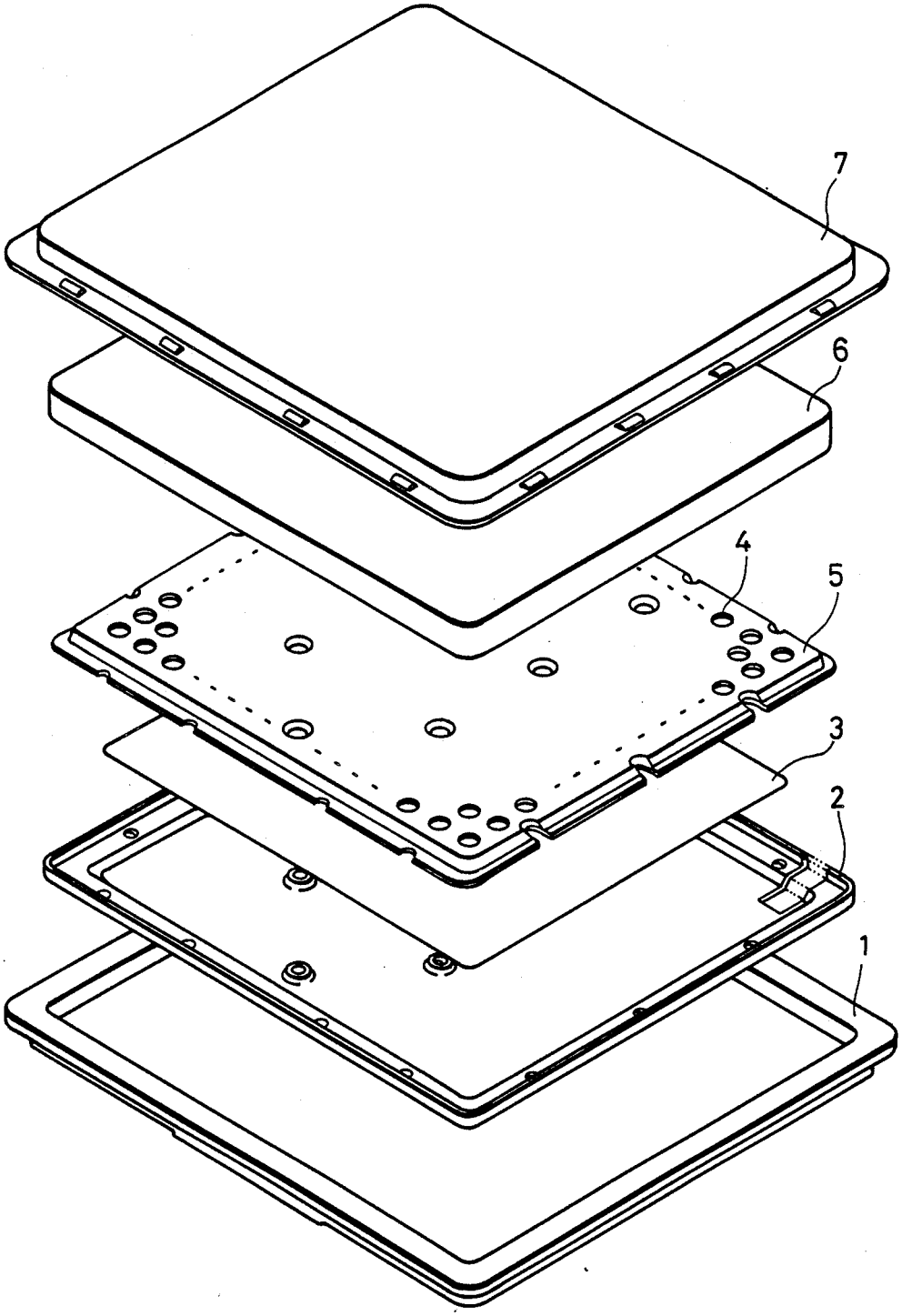
FIG. 1 (PRIOR ART)
FIG. 1 is an exploded, perspective view of a conventional planar antenna.

While the conductive surfaces are formed on the inner surfaces of both the radome and the rear cover in FIGS. 3 and 4, the conductive surface can be formed on one of the inner surface and the other inner surface has the same structure as that of the conventional antenna shown in FIG. 1 with the same effects of the present invention being achieved.

According to the present invention, as described above, since the conductive surface is formed on the entire rear (inner) surface of the radome, except the portions corresponding to the antenna elements, and/or the conductive surface is formed on the entire front (inner) surface of the rear cover and these conductive surfaces and antenna elements constitute the radiators, the number of assembly parts of the antenna can be reduced, the structure of the antenna can be simplified, the manufacturing cost thereof can be reduced, the antenna can be reduced in thickness and in weight, and the productivity and the reliability of the antenna of the invention can be improved.

It should be understood that the above description is presented by way of example on a single preferred embodiment of the invention and it will be apparent that many modifications and variations thereof could be effected by one with ordinary skill in the art without departing from the spirit and scope of the novel concepts of the invention so that the scope of the invention should be determined only by the appended claims.

It is claimed:

1. A suspended line feed type planar antenna comprising:

a substrate sandwiched between top and bottom conductive surfaces;

a plurality of radiators provided on said substrate;

a radome positioned at the upper side of said top conductive surface; and a rear cover positioned at the lower side of said bottom conductive surface, characterized in that at least one of said top and bottom conductive surfaces is formed on one of the inner surfaces of said radome and said rear cover.

2. An antenna according to claim 1, wherein said bottom conductive surface is formed on the inner surface of said radome.

3. An antenna according to claim 1, wherein said top conductive surface is formed on the inner surface of said rear cover.

4. An antenna according to claim 1, wherein said top and bottom conductive surfaces are formed on the inner surfaces of said radome and said rear cover, respectively.

5. A suspended line feed type planar antenna comprising:

a substrate sandwiched between top and bottom conductive surfaces;

a plurality of radiators provided on said substrate;

a plastic radome positioned at the upper side of said top conductive surface; and a plastic rear cover positioned at the lower side of said bottom conductive surface, characterized in that at least one of said top and bottom conductive surfaces is formed on one of the inner surfaces of said radome and said rear cover as a metallized surface thereof.

6. An antenna according to claim 5, wherein said top and bottom conductive surfaces are formed on the inner surfaces of said radome and said rear cover as metallized surfaces thereof, respectively.

7. A suspended line type planar antenna comprising:

a substrate sandwiched between top and bottom conductive surfaces, said top conductive surface having a plurality of spaced openings defining radiation openings;

a corresponding plurality of radiators provided on said substrate in alignment with said plurality of openings, respectively;

feeding means for co-phase feeding said radiators;

plastic radome positioned at the upper side of said top conductive surface; and a plastic rear cover positioned at the lower side of said bottom conductive surface, characterized in that at least one of said top and bottom conductive surfaces is formed on one of the inner surface of said radome and said rear cover as a metallized surface thereof.

8. An antenna according to claim 7, wherein said top and bottom conductive surfaces are formed on the inner surfaces of said radome and said rear cover as metallized surfaces thereof, respectively.

9. An antenna according to claim 8, wherein said radiators are patch radiators, respectively.

10. An antenna according to claim 9, wherein said patch radiators are formed as printed circuit elements on said substrate.

* * * * *